US010809659B2

(12) United States Patent
Ueno et al.

(10) Patent No.: US 10,809,659 B2
(45) Date of Patent: Oct. 20, 2020

(54) CLEANING DEVICE AND IMAGE FORMING APPARATUS

(71) Applicant: KYOCERA Document Solutions Inc., Osaka (JP)

(72) Inventors: Masahiro Ueno, Osaka (JP); Hirofumi Tsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/667,539

(22) Filed: Oct. 29, 2019

(65) Prior Publication Data

US 2020/0142346 A1 May 7, 2020

(30) Foreign Application Priority Data

Nov. 6, 2018 (JP) ..... 2018-209027

(51) Int. Cl.
*G03G 15/00* (2006.01)
*G03G 21/00* (2006.01)

(52) U.S. Cl.
CPC ..... *G03G 21/0058* (2013.01)

(58) Field of Classification Search
CPC ..... G03G 21/0058
See application file for complete search history.

(56) References Cited

U.S. PATENT DOCUMENTS

2013/0084103 A1* 4/2013 Hashimoto ..... G03G 15/5008 399/167
2018/0335746 A1* 11/2018 Nosho ..... G03G 15/757

FOREIGN PATENT DOCUMENTS

JP 2003167489 A 6/2003
JP 2007108509 A 4/2007

* cited by examiner

*Primary Examiner* — Clayton E. LaBalle
*Assistant Examiner* — Michael A Harrison
(74) *Attorney, Agent, or Firm* — Studebaker & Brackett PC

(57) ABSTRACT

A cleaning device includes a cleaning roller, a bearing member, a guiding member and an energizing member. The cleaning roller includes a second gear meshed with a first gear of an image carrier. The cleaning roller is rotationally driven in an opposite direction to the image carrier by driving force transmitted from the first gear to the second gear. The bearing member supports a core metal of the cleaning roller. The guiding member has a placement face on which the bearing member is placed. The placement face is inclined with regard to a straight line passing through a rotation center of the first gear and a rotation center of the second gear so that a distance between the straight line and the placement face becomes larger, the closer to the first gear. The energizing member energizes the bearing member so as to press the cleaning roller to the image carrier.

14 Claims, 6 Drawing Sheets

COMPARATIVE EXAMPLE

CLEANING DEVICE AND IMAGE FORMING APPARATUS

INCORPORATION BY REFERENCE

This application is based on and claims the benefit of priority from Japanese Patent application No. 2018-209027 filed on Nov. 6, 2018, the entire contents of which are incorporated herein by reference.

BACKGROUND

The present disclosure relates to a cleaning device cleaning an image carrier and an image forming apparatus including this cleaning device.

An image forming apparatus of an electrographic manner is configured to developing an latent image imaged on a photosensitive body as an image carrier by a toner. The amorphous silicon based photosensitive body is known as a member achieving prolongation of life of the photosensitive body, but there is a problem that the amorphous silicon based photosensitive body easily causes image deletion. Image deletion is caused when an electric charge of the latent image moves on a surface of the photosensitive body due to an effect of discharge product adhered on the surface of the photosensitive body.

Thereupon, in a conventional image forming apparatus, technique of removing the discharge product on the surface of the photosensitive body is considered. For example, there is an image forming apparatus removing the discharge product by rubbing the surface of the photosensitive body with a cleaning roller having a rubber layer.

Incidentally, in a cleaning device of a conventional image forming apparatus, a cleaning roller is supported by a bearing roller rotating around a fulcrum, and the bearing member is energized by a spring so that the cleaning roller is pressed to the photosensitive body. However, in such a configuration, because some distance is required between the fulcrum of the bearing member and an action point of the spring, there in a problem that space saving is difficult.

In order to achieve space saving of the cleaning device, for example, it is considered to provide a guiding member allowing to slide the bearing member in a direction between a rotation center of the cleaning roller and a rotation center of the photosensitive body. However, in a case of a configuration transmitting driving force from a first gear connected to a rotation shaft of the photosensitive body to a second gear connected to the cleaning roller, the driving force acts in a direction of an action line corresponding to a pressure angle set to the first gear and the second gear. Because this action line is inclined with regard to a sliding direction of the bearing member, a component in the sliding direction of the driving force acts in a direction pushing back the bearing member against energization of the spring, and pressing of the cleaning roller to the photosensitive body is hindered.

SUMMARY

In accordance with the present disclosure, a cleaning device includes a cleaning roller, a bearing member, a guiding member and an energizing member. The cleaning roller includes a second gear meshed with a first gear. The first gear is connected to an image carrier carrying a toner image and is rotationally driven. The cleaning roller is rotationally driven in an opposite direction to a rotation direction of the image carrier by driving force transmitted from the first gear to the second gear. The bearing member supports a core metal of the cleaning roller. The guiding member has a placement face on which the bearing member is placed. The placement face is inclined with regard to a straight line passing through a rotation center of the first gear and a rotation center of the second gear so that a distance between the straight line and the placement face becomes larger, the closer to the first gear. The energizing member energizes the bearing member so as to press the cleaning roller to the image carrier.

In accordance with the present disclosure, an image forming apparatus includes the cleaning device as described above, and an image forming part including the image carrier and forming an image on a sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the accompanying drawings, a printer 1 (an example of an image forming apparatus) and a cleaning device 23 according to an embodiment of the present disclosure will be described.

Figure 1:
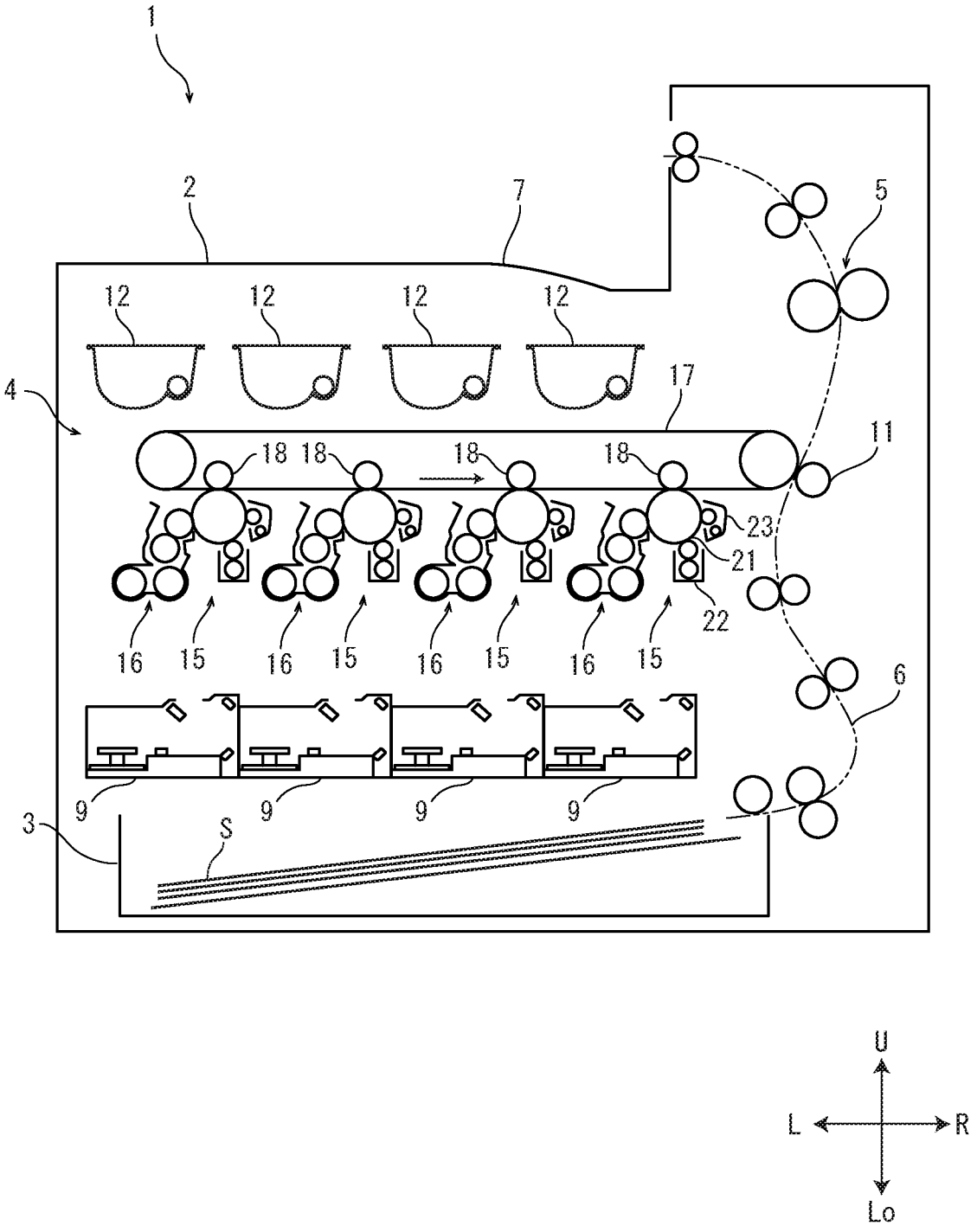
FIG. 1 is a sectional view schematically showing an internal structure of a printer according to an embodiment of the present disclosure.

First, with reference to FIG. 1, an entire configuration of the printer 1 will be described. FIG. 1 is a sectional view schematically showing an internal structure of the printer 1. Hereinafter, it will be described so that the front side of the printer 1 is positioned at a near side on a paper sheet of FIG. 1 and that left and right directions is defined as seen from the front side of the color printer 1. Arrows U, Lo, L, R, Fr and Rr in each of the drawings respectively indicate an upper side, a lower side, a left side, a right side, a front side and a rear side of the printer 1.

In a housing 2 of the printer 1, a sheet feeding device 3 feeding a stored sheet S to a conveying path 6, an image forming part 4 forming a toner image on the sheet S, a fixing device 5 fixing the toner image onto the sheet S, and an ejecting part 7 ejecting the sheet S having the fixed toner image are provided.

The image forming part 4 includes drum units 15, exposing devices 9, toner containers 12, developing units 16, an intermediate transferring belt 17, primary transferring rollers 18, and a secondary transferring roller 11.

The drum unit 15 includes a rotationally driven photosensitive drum 21 (an example of an image carrier), a charging device 22 electrically charging the photosensitive drum 21, a cleaning device 23 cleaning a surface of the photosensitive drum 21.

The exposing device 9 irradiates the photosensitive drum 21 with a laser light on the basis of image data. The toner containers 12 respectively contain toners of black, cyan, magenta and yellow.

The developing unit 16 includes a developing case, a magnetic roller, and a conveying screw. Between the developing case and the toner container 12, a supplying path (not shown) for the toner is provided, and the developing case stores the toner supplied from the toner container 12. The magnetic roller is disposed so as to be exposed from an opening of the developing case and to face to the conveying screw and the photosensitive drum 21.

The intermediate transferring belt 17 is an endless belt wound around a driving roller and a following roller, is disposed so that an outer face of the intermediate transferring belt 17 faces to the photosensitive drum 21, and is cyclically run. The primary transferring roller 18 is disposed so as to face to an inner face of the intermediate transferring belt 17, and sandwiches the intermediate transferring belt 17 with the photosensitive drum 21.

The secondary transferring roller 11 is disposed to faces to the outer face of the intermediate transferring belt 17 across the conveying path 6.

Next, an image forming operation of the printer 1 will be described. When the printer 1 receives the image data from an external device or the like, the sheet S is fed from the sheet feeding device 3 to the conveying path 6. On the surface of each of the electrically charged photosensitive drums 21, a latent image on the basis of the image data of black, cyan, magenta or yellow is formed by each of the exposing devices 9. In each of the developing devices 16 each of the developing devices 16, the toner stored in the developing case is supplied to the magnetic roller by the conveying screw. This toner is adsorbed to the latent image, and thereby, the toner image is formed on the photosensitive drum 21. The toner images carried on the respective photosensitive drums 21 are transferred on the intermediate belt 17 by the respective primary transferring rollers 18 in layers. The toner images transferred on the intermediate belt 17 are transferred on the sheet S by the secondary transferring roller 11, and are fixed onto the sheet S by the fixing device 5. The sheet S having the fixed toner images is ejected by the ejecting part 7. The toner remained on the surface of each photosensitive drum 21 is removed by each cleaning device 23.

Figure 2:
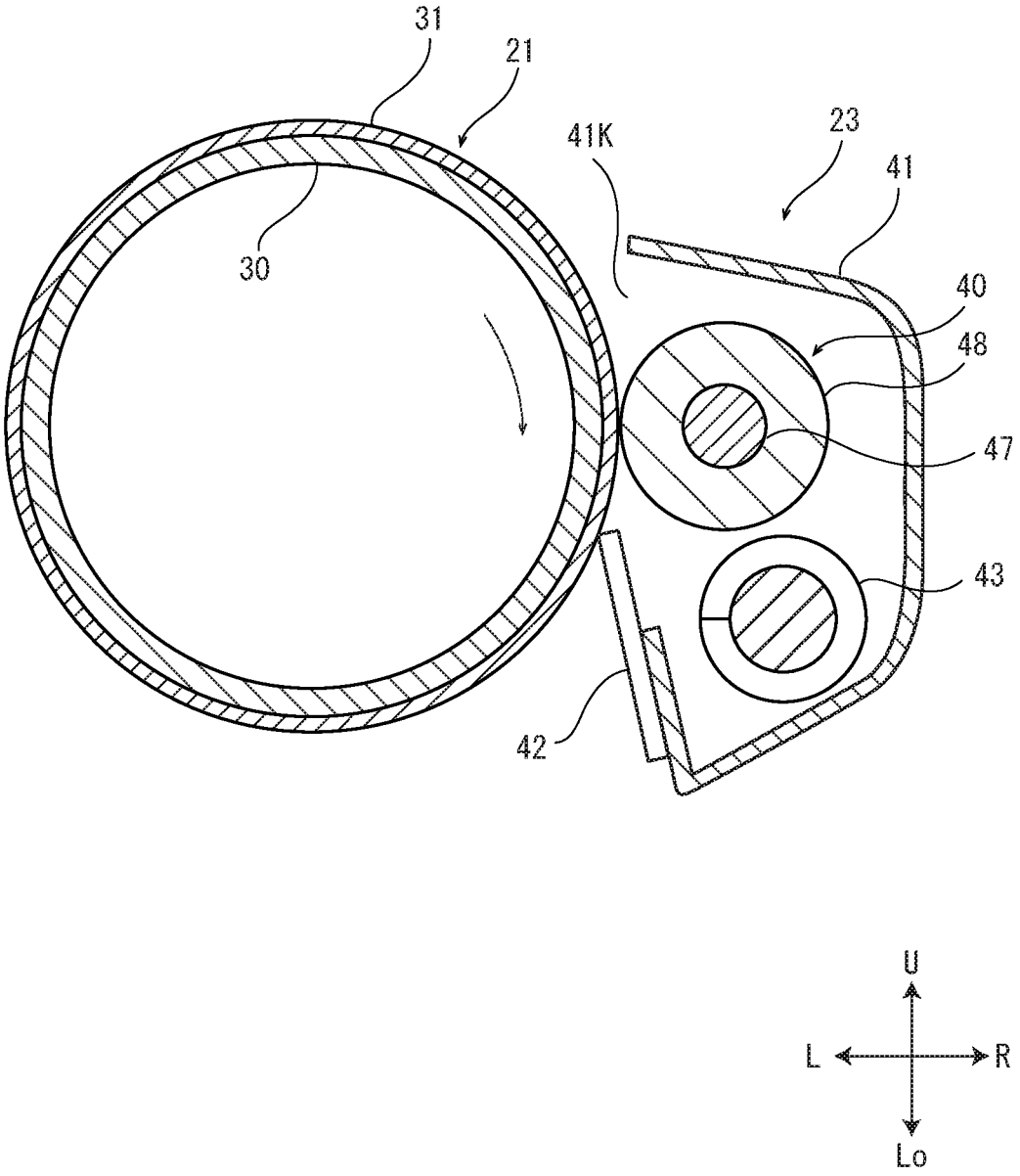
FIG. 2 is a sectional view showing a cleaning device according to the embodiment of the present disclosure.
Figure 3:
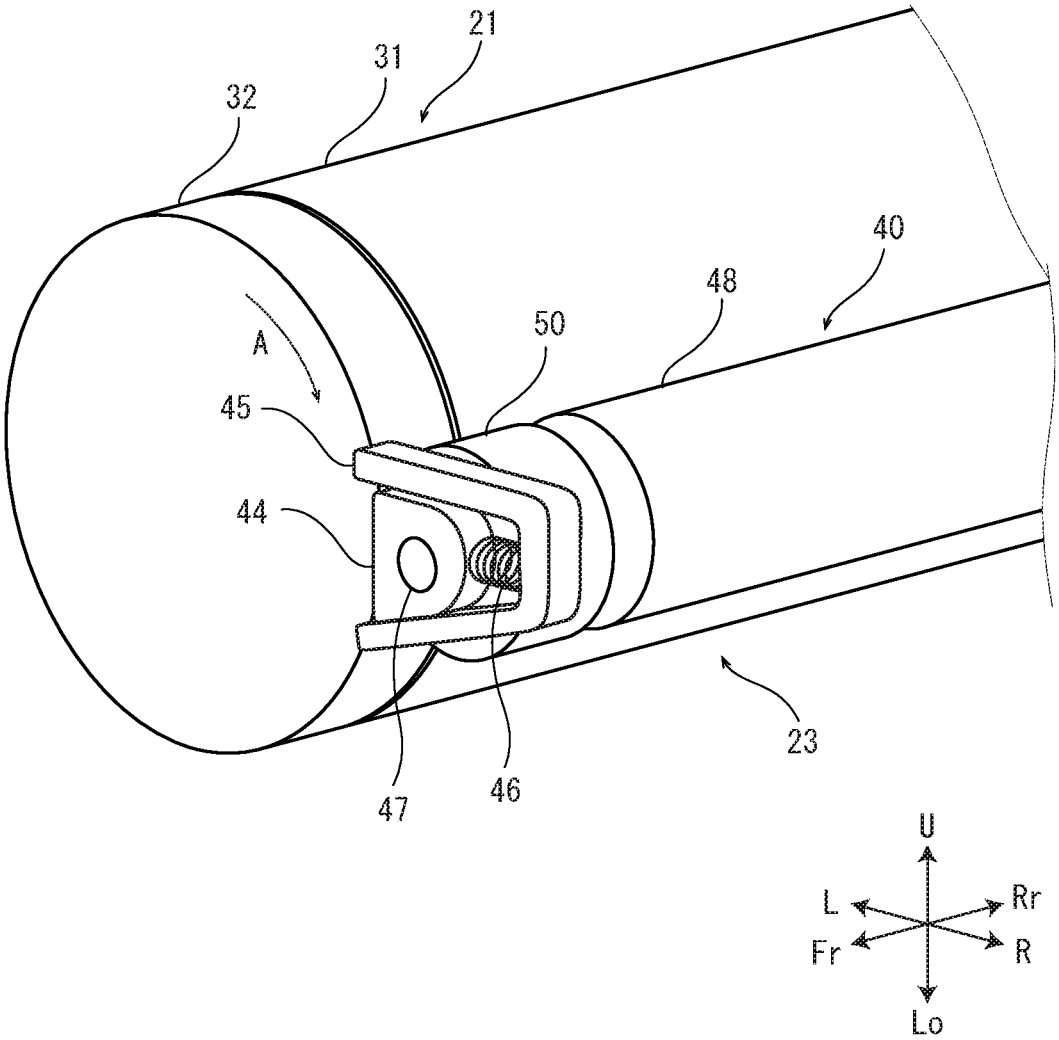
FIG. 3 is a perspective view showing the cleaning device according to the embodiment of the present disclosure.
Figure 4:
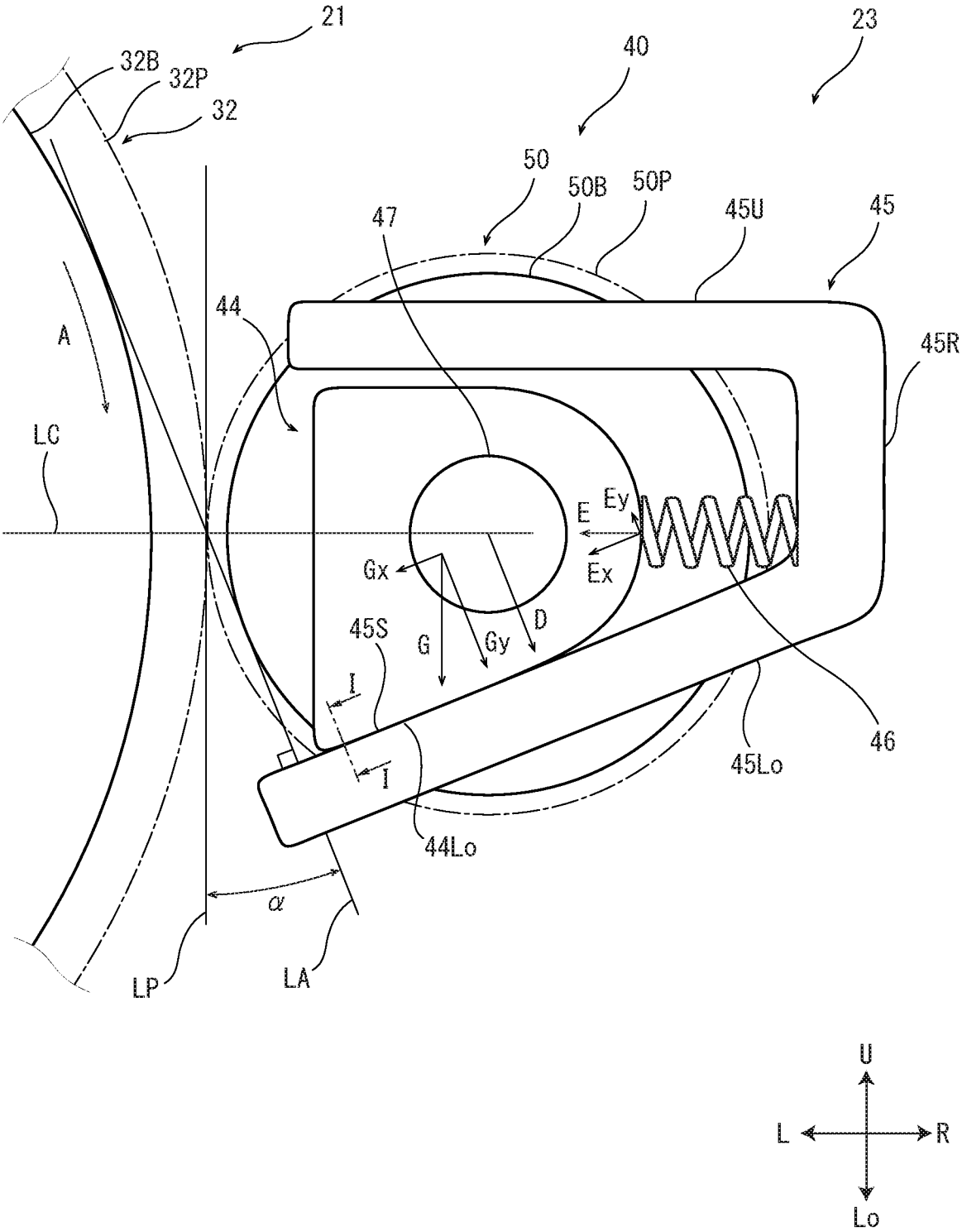
FIG. 4 is a front view showing the cleaning device according to the embodiment of the present disclosure.

Next, with reference to FIGS. 2-5, configurations of the photosensitive drum 21 and the cleaning device 23 will be described. FIG. 2 is a sectional view of the cleaning device 23. FIG. 3 is a perspective view of the cleaning device 23. FIG. 4 is a front view of the cleaning device 23. Incidentally, hereinafter, front parts of the photosensitive drum 21 and the cleaning device 23 will be described, but rear parts of the photosensitive drum 21 and the cleaning device 23 are configured similar to the front parts. However, a driving force transmitting mechanism including a first gear 32 and a second gear 50 may be provided in each of a front side and a rear side, or alternatively, may be provided in either one of the front side and the rear side.

The photosensitive drum 21 includes a core metal elongated in forward and backward directions as a longitudinal direction, a photosensitive layer 31 formed on an outer circumferential face of the core metal 30, and the first gear 32 connected to the core metal 30. The core metal 30 is a cylindrical member made of aluminum alloy or the like. The photosensitive layer 31 is made of an amorphous silicon based photosensitive body. The first gear 32 is a helical gear having the same rotation center as the core metal 30, is made of resin, metal or other, and is connected to an end face of the core metal 30. The photosensitive drum 21 is supported by a bearing (not shown) fixed to the housing 2, and receives driving force transmitted from a driving source (not shown), such as a motor to the first gear 32, and then, driven and rotated in an A direction in FIGS. 3 and 4.

The cleaning device 23 includes a cleaning roller 40 pressed to the photosensitive drum 21, a cleaning case 41 receiving a waste toner, a cleaning blade 42 butted to the photosensitive drum 21, a conveying screw 43 conveying the waste toner, a bearing member 44 supporting the cleaning roller 40, a guiding member 45 guiding movement of the bearing member 44, and an energizing member 46 energizing the bearing member 44.

The cleaning roller 40 includes a core metal 47 elongated in the forward and backward directions as a longitudinal direction, an elastic layer 48 formed on an outer circumferential face of the core metal 47, and the second gear 50. The core metal 47 is a columnar member or a cylindrical member made of stainless steel or the like. The elastic layer 48 is made of foamed rubber or the like.

The second gear 50 is a helical gear having the same rotation center as the core metal 47, is made of resin, metal or other, is connected to the outer circumferential face of the core metal 47, and is meshed with the first gear 32. A gear ratio between the first gear 32 and the second gear 50 is different from a ration between a perimeter of the photosensitive drum 21 and a perimeter of the cleaning roller 40. Therefore, the cleaning roller 40 is rotated at surface speed different from the photosensitive drum 21. In the embodiment, the first gear 32 and the second gear 50 are disposed so that the rotation center of the first gear 32 and the rotation center of the second gear 50 are positioned at the same level as each other (so that a straight line LC passing through the rotation center of the first gear 32 and the rotation center of the second gear 50 becomes horizontal).

The cleaning case 41 is made of resin or the like, and houses the cleaning roller 40 and the conveying screw 43. The cleaning case 41 has an opening 41K at a side of the photosensitive drum 21, and is disposed so that the cleaning roller 40 is exposed via the opening 41K. To the cleaning case 41, a waste toner receptacle (not shown) is connected.

The cleaning blade 42 is made of resin or the like, is attached to a part of the cleaning case 41 at a lower side from the opening 41K, and is disposed so that a distal end of the cleaning blade 42 is butted to the photosensitive drum 21.

The conveying screw 43 is made of resin, metal or other, and has a shaft elongated in the forward and backward directions as a longitudinal direction and a helical blade formed around the shaft. The conveying screw 43 is disposed below the cleaning roller 40, and is driven by a driving source (not shown), such as a motor.

The bearing member 44 is made of resin or the like, and is internally provided with a bearing supporting the core metal 47 of the cleaning roller 40. A lower face 44Lo of the bearing member 44 is formed in a planar shape.

The guiding member 45 is made of resin or the like, is fixed to the housing 2, and guides movement of the bearing member 44. The guiding member 45 has a lower part 45Lo having a placement face 45S on which the bearing member 44 is placed, a right part 45R formed at an upper side from a right end of the lower part 45Lo and positioned at a right side from the bearing member 44, and an upper part 45U formed at a left side from an upper end of the right part 45R and positioned at an upper side from the bearing member 44. Between a lower face of the upper part 45U of the guiding member 45 and an upper end of the bearing member 44, a gap is arranged.

The placement face 45S is formed in a planar shape. In the guiding member 45, the placement face 45S is inclined with regard to the straight line LC passing through the rotation center of the first gear 32 and the rotation center of the second gear 50 so that a distance between the straight line LC and the placement face 45S becomes larger, the closer to the first gear 32. In the embodiment, because the straight line LC is horizontal, the placement face 45S is inclined so that a side of the first gear 32 becomes lower. In addition, in the embodiment, the placement face 45S is disposed vertically with regard to an action line LA of the first gear 32 and the second gear 50. Here, the action line LA is a common tangent line of a basic circle 32B of the first gear 32 and a basic circle 50B of the second gear 50. With respect to a common tangent line LP of a pitch circle 32P of the first gear 32 and a pitch circle 50P of the second gear 50, an angle $\alpha$ of an intersection of the common tangent line LP and the action line LA is a meshing pressure angle. The bearing member 44 is placed on the placement face 45S so that the lower face 44Lo comes into contact with the placement face 45S.

The energizing member 46 is a compression coil spring, is inserted between a right end of the bearing member 44 and a left face of the right part 45R of the guiding member 45, and energizes the bearing member 44 to a left side.

Next, cleaning operation of the cleaning device 23 will be described. When the photosensitive drum 21 is driven by the driving force transmitted from the driving source to the first gear 32, the driving force is transmitted from the first gear 32 to the second gear 50, and then, the cleaning roller 40 is rotated in an opposite direction to the photosensitive drum 21. At this time, because the cleaning roller 40 is rotated at surface speed different from the photosensitive drum 21, the cleaning roller 40 rubs the photosensitive drum 21. Accordingly, the toner remained on the photosensitive drum 21 after transferring of the toner image onto the sheet S is adhered onto the cleaning roller 40. Because the toner comprises abrasive, such as alumina or titanium oxide, mixed therein, the surface of the photosensitive drum 21 is grinded, and then, the remained toner is scraped. When some toner is remained on the photosensitive drum 21 after grinding, the some remained toner is scraped by the cleaning blade 42. The waste toner collected inside the cleaning case 41 is conveyed in the longitudinal direction of the conveying screw 43 by the conveying screw 43, and is ejected into a waste toner receptacle.

Figure 5:
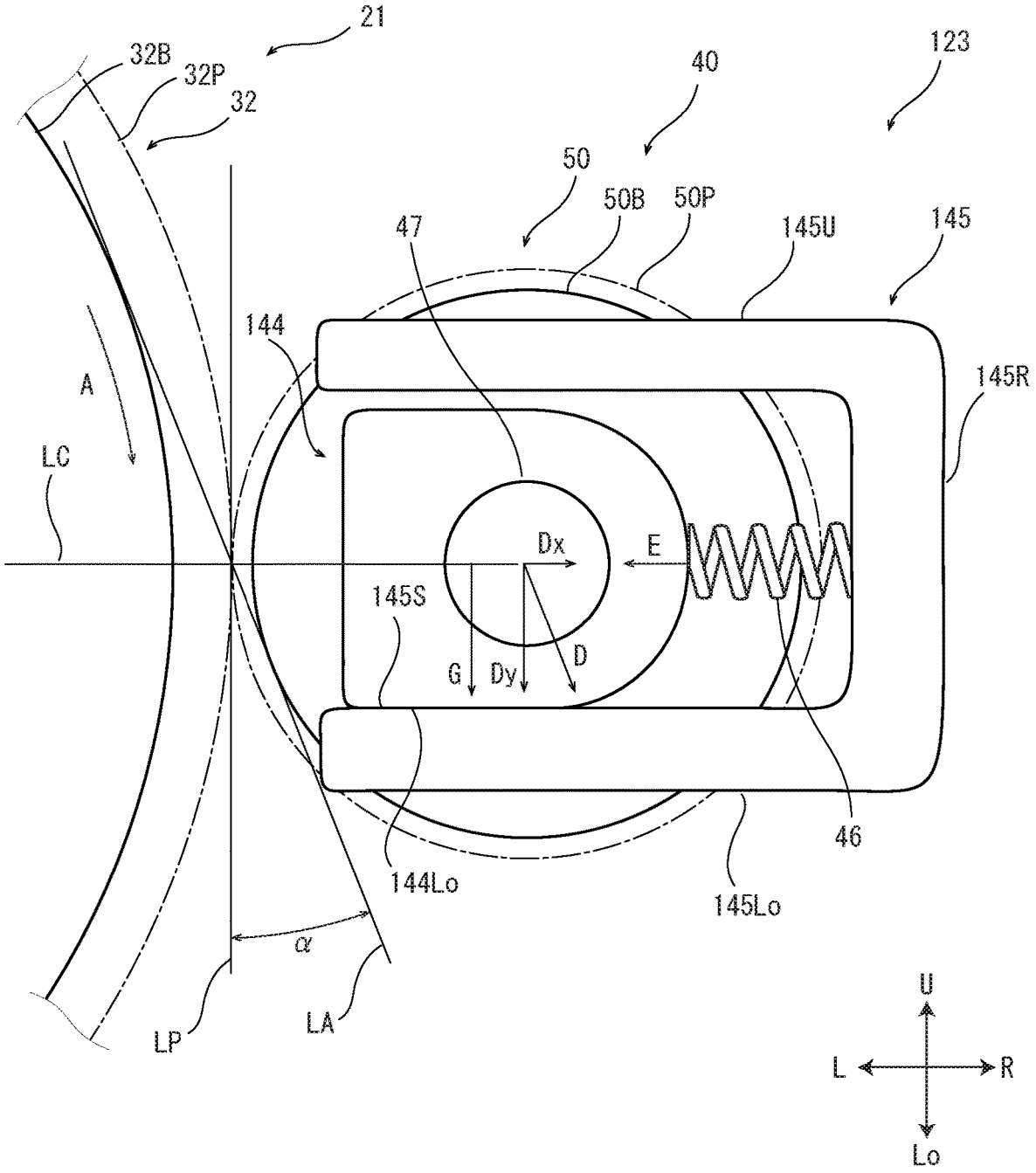
FIG. 5 is a front view showing a cleaning device of a comparative example against the embodiment of the present disclosure.

Next, effects of the embodiment will be described by comparing with a comparative example shown in FIG. 5. FIG. 5 is a front view showing a cleaning device 123 of the comparative example against the embodiment.

In the comparative example, a placement face 145S of a lower part 145Lo of a guiding member 145 is formed horizontal. As external force acting on the guiding member 145, there are gravity G, elastic force E of an energizing member 46, and a part D of driving force transmitted to a second gear 50 from a first gear 32. The driving force of the first gear 32 is transmitted in a direction of an action line LA with regard to teeth of the second gear 50, the majority of the driving force is consumed in rotation of the second gear 50, the residual part D of the driving force acts on a bearing member 144 so as to press the bearing member 144 in the action line LA. Because a component Dx in a parallel direction to the placement face 145S of the part D of the driving force acts in an opposite direction to the elastic force E of the energizing member 46, pressing of the cleaning roller to the photosensitive drum 21 is hindered by the component Dx. Because the gravity G acts vertical to the placement face 145S, the gravity G does not act in the parallel direction to the placement face 145S. Incidentally, magnitudes of vectors of the gravity G, the elastic force E and the part D of the driving force illustrated in FIG. 5 do not direct relation of actual forces.

On the other hand, in the embodiment, since the placement face 45S is disposed vertical to the action line LA, a component in a parallel direction to the placement face 45S of a part D of the driving force is negligibly small in comparison with the comparative example. Moreover, a component Gx in a parallel direction to the placement face 45S of gravity G acts in the same direction as a component Ex in a parallel direction to the placement face 45S of elastic force E of the energizing member 46. Therefore, in the embodiment, pressing of the cleaning roller 40 to the photosensitive drum 21 is not hindered. Incidentally, magnitudes of vectors of the gravity G, the elastic force E and the part D of the driving force illustrated in the figures do not direct relation of actual forces.

In accordance with the cleaning device 23 according to the embodiment described above, it is possible to achieve space saving of the cleaning device 23 and to restrain action of hindering the pressing of the cleaning roller 40 to the photosensitive drum 21. Moreover, in accordance with the cleaning device 23 according to the embodiment, since the placement face 45S is disposed vertical to the action line LA, the action of hindering the pressing of the cleaning roller 40 to the photosensitive drum 21 becomes negligibly small.

The above-described embodiment may be modified as follows.

Although, in the above-described embodiment, an example that the straight line LC passing through the rotation center of the first gear 32 and the rotation center of the second gear 50 is horizontal is described, the present disclosure may be applied into a case where the straight line LC is not horizontal.

Although, in the above-described embodiment, an example that the placement face 45S is formed vertical to the action line LA of the first gear 32 and the second gear 50 is described, the present disclosure may be applied into a case where the placement face 45S is not formed vertical to the action line LA. Even if the placement face 45S is not formed vertical to the action line LA, when the placement face 45S is inclined with regard to the straight line LC passing through the rotation center of the first gear 32 and the rotation center of the second gear 50 so that the distance between the straight line LC and the placement face 45S becomes larger, the closer to the first gear 32, it is possible to restrain action of hindering the pressing of the cleaning roller 40 to the photosensitive drum 21.

Figure 6A:
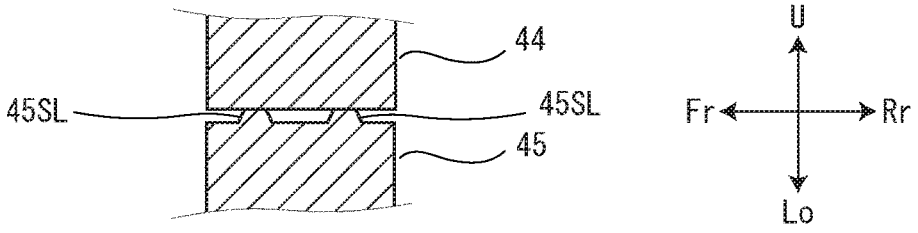
FIG. 6A is a sectional view showing a cleaning device according to a modification example of the embodiment of the present disclosure.
Figure 6B:
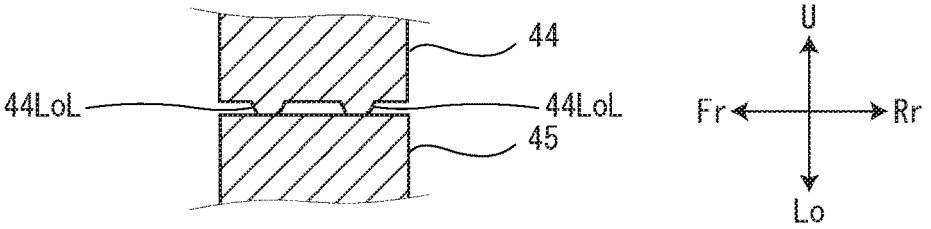
FIG. 6B is a sectional view showing a cleaning device according to a modification example of the embodiment of the present disclosure.
Figure 6C:
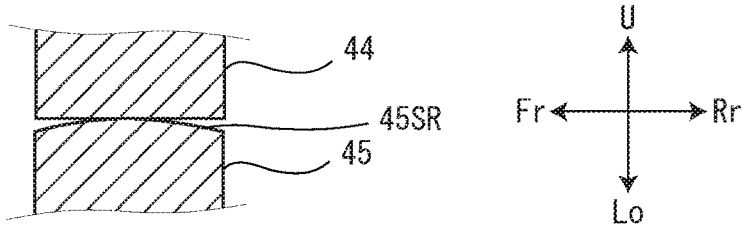
FIG. 6C is a sectional view showing a cleaning device according to a modification example of the embodiment of the present disclosure.
Figure 6D:
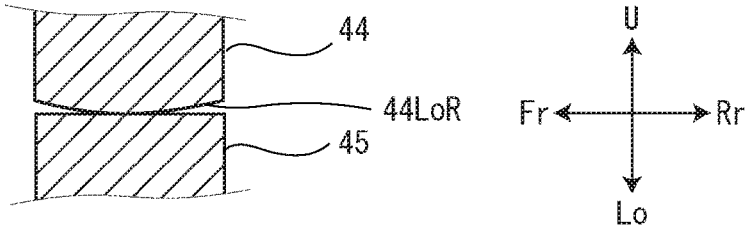
FIG. 6D is a sectional view showing a cleaning device according to a modification example of the embodiment of the present disclosure.

FIGS. 6A-6D are sectional views illustrating modification examples of the embodiment. The sectional views are taken along I-I line in FIG. 4. As shown in FIG. 6A, ribs 45SL may be formed on the placement face 45S. For example, the ribs 45SL are provided at several positions in a rotation axis direction of the second gear on the placement face 45S, and are extended in a crossing direction to the rotation axis direction of the second gear 50 and the action line LA (the same direction as the component Ex). As shown in FIG. 6B, ribs LoL may be formed on the lower face 44Lo (a contact face with the placement face 45S) of the bearing member 44. For example, the ribs LoL are provided at several positions in the rotation axis direction of the second gear 50 on the lower face 44Lo, and are extended in the crossing direction to the rotation axis direction of the second gear 50 and the action line LA (the same direction as the component Ex). As shown in FIG. 6C, the placement face 45S may be formed as a curved face 45SR expanded to a side of the bearing member 44. For example, the curved face 45SR has a curvature radius in parallel to the action line LA over the crossing direction to the rotation axis direction of the second gear 50 and the action line LA (the same direction as the component Ex). As shown in FIG. 6D, the lower face 44Lo (the contact face with the placement face 45S) of the bearing member 44 may be formed as a curved face 44LoR expanded to a side of the guiding member 45. For example, the curved face 44LoR has a curvature radius in parallel to the action line LA over the crossing direction to the rotation axis direction of the second gear 50 and the action line LA (the same direction as the component Ex). In accordance with these modification examples, it is possible to reduce frictional resistance of the bearing member 44 and the guiding member 45.

The first gear 32 and the second gear 50 may be spur gears.

The present disclosure may be applied to a cleaning device cleaning the intermediate belt 17 (an example of the image carrier).

The present disclosure may be applied to a printer forming a color image by using toners of two colors, three colors, or five or more colors. The present disclosure may be applied to a printer forming a monochrome image by using a toner of one color.

Incidentally, the above-description of the embodiments illustrates one aspect of the cleaning device according to the present disclosure and the image forming apparatus including this cleaning device, but the technical scope of the disclosure is not limited to the above-described embodiments.

The invention claimed is:

1. A cleaning device comprising:

a cleaning roller including a second gear meshed with a first gear, the first gear being connected to an image carrier, the image carrier being rotationally driven while carrying a toner image, and the cleaning roller being rotationally driven in an opposite direction to a rotation direction of the image carrier by driving force transmitted from the first gear to the second gear;

a bearing member supporting a core metal of the cleaning roller;

a guiding member having a placement face on which the bearing member is placed, the placement face being inclined with regard to a straight line passing through a rotation center of the first gear and a rotation center of the second gear so that a distance between the straight line and the placement face becomes larger, the closer to the first gear; and an energizing member energizing the bearing member so as to press the cleaning roller to the image carrier, wherein the placement face is disposed vertical to an action line of the first gear and the second gear, and the energizing member is inserted between an end of the bearing member and a side face of the side part of the guiding member, and is arranged in parallel to the straight line passing through a rotation center of the first gear and a rotation center of the second gear.

2. The cleaning device according to claim 1 wherein, a rib is formed on the placement face.

3. The cleaning device according to claim 1 wherein, a rib is formed on a contact face of the bearing member with the placement face.

4. The cleaning device according to claim 1 wherein, the placement face is a curved face expanded to a side of the bearing member.

5. The cleaning device according to claim 1 wherein, a contact face of the bearing member with the placement face is a curved face expanded to a side of the guiding member.

6. The cleaning device according to claim 1 wherein, the first gear and the second gear are helical gears.

7. The cleaning device according to claim 1 wherein, the first gear and the second gear are disposed so that a rotation center of the first gear and a rotation center of the second gear are positioned at the same level as each other.

8. An image forming apparatus comprising:

the cleaning device according to claim 1; and an image forming part including the image carrier and forming an image on a sheet.

9. An image forming apparatus comprising:

the cleaning device according to claim 2; and an image forming part including the image carrier and forming an image on a sheet.

10. An image forming apparatus comprising:

the cleaning device according to claim 3; and an image forming part including the image carrier and forming an image on a sheet.

11. An image forming apparatus comprising:

the cleaning device according to claim 4; and an image forming part including the image carrier and forming an image on a sheet.

12. An image forming apparatus comprising:

the cleaning device according to claim 5; and an image forming part including the image carrier and forming an image on a sheet.

13. An image forming apparatus comprising:

the cleaning device according to claim 6; and an image forming part including the image carrier and forming an image on a sheet.

14. An image forming apparatus comprising:

the cleaning device according to claim 7; and an image forming part including the image carrier and forming an image on a sheet.

* * * * *